US011420797B2

(12) United States Patent
Gerberzahn et al.

(10) Patent No.: US 11,420,797 B2
(45) Date of Patent: Aug. 23, 2022

(54) CONTAINER CLOSURE AND RELATED METHODS

(71) Applicants: Henkel IP & Holding GmbH, Düesseldorf (DE); Henkel AG & Co. KGaA, Düesseldorf (DE)

(72) Inventors: Rainer Gerberzahn, Juechen (DE); Mark C. Mikol, Phoenix, AZ (US); Carsten Bertram, Scottsdale, AZ (US); Bernhard Orlich, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 15/788,614

(22) Filed: Oct. 19, 2017

(65) Prior Publication Data

US 2019/0119007 A1 Apr. 25, 2019

(51) Int. Cl.

| | |
|---|---|
| ***B65D 41/26*** | (2006.01) |
| ***B65D 51/24*** | (2006.01) |
| ***B65D 41/04*** | (2006.01) |

(52) U.S. Cl.

CPC ..... *B65D 41/26* (2013.01); *B65D 41/04* (2013.01); *B65D 51/24* (2013.01)

(58) Field of Classification Search

CPC ..... B65D 41/26; B65D 41/56; A61B 3/0008; A61B 3/022; A61B 3/00

USPC ..... 215/230; 351/237, 239

See application file for complete search history.

(56) References Cited

U.S. PATENT DOCUMENTS

| | | | | |
|---|---|---|---|---|
| 4,412,729 | A * | 11/1983 | Hartmann | A61B 3/032 351/237 |
| 5,325,136 | A * | 6/1994 | Salibello | A61B 3/032 351/243 |
| 2015/0284150 | A1* | 10/2015 | Doubles | B65D 41/26 222/1 |
| 2015/0310782 | A1* | 10/2015 | Shipman | G09F 13/18 40/542 |
| 2016/0109276 | A1* | 4/2016 | Larson | G01F 19/00 222/157 |

(Continued)

FOREIGN PATENT DOCUMENTS

| | | |
|---|---|---|
| JP | H08-48348 A | 2/1996 |
| JP | 2000142741 A | 5/2000 |

(Continued)

OTHER PUBLICATIONS

International Search Report and Written Opinion of the International Searching Authority dated Jan. 11, 2019, in International Application No. PCT/US2018/051659, filed Sep. 19, 2018; 14 pages.

*Primary Examiner* — Anthony D Stashick
*Assistant Examiner* — Raven Collins
(74) *Attorney, Agent, or Firm* — St. Onge Steward Johnston & Reens LLC

(57) ABSTRACT

A container closure includes a dosage body including at least one peripheral wall defining a containment chamber. The peripheral wall has an internal wall surface adjacent the containment chamber, the internal wall surface having a surface luminance. Indicia is carried by the internal wall surface, the indicia having an indicia luminance. A contrast between the surface luminance and the indicia luminance is at least about 0.67% on the Weber scale.

19 Claims, 2 Drawing Sheets

(56) References Cited

U.S. PATENT DOCUMENTS

| | | | | |
|---|---|---|---|---|
| 2019/0077177 | A1* | 3/2019 | Hawthorne | G06F 1/1656 |
| 2019/0220717 | A1* | 7/2019 | Shannon | G06K 7/1417 |

FOREIGN PATENT DOCUMENTS

| | | | |
|---|---|---|---|
| JP | 2005263242 | A | 9/2005 |
| JP | 2010235154 | A | 10/2010 |

* cited by examiner

CONTAINER CLOSURE AND RELATED METHODS

BACKGROUND OF THE INVENTION

Laundry care products such as detergent and fabric softeners are often provided in bottle or container with a cap to secure the product within the container. In many instances, the cap can have an internal volume that can be used to measure and dispense a quantity of the laundry care product as part of a laundry care operation. These caps or closures can include level indicators formed inside thereof that provide the user with an indication of the volume of product being dispensed.

In some cases, these level indicators are formed within a wall of the cap or closure during the process of fabrication, such as molding. Generally, the mold includes a negative impression of the desired level indicators, and this negative impression creates a positive structure in the wall of the cap or closure when it is formed.

While this system has proven somewhat desirable by consumers, conventional systems have proved problematic in a number of ways. These problems include, for example, readability, flexibility of design change, and prohibitive cost, among others.

SUMMARY OF THE INVENTION

In accordance with one aspect of the invention, a container closure or cap is provided, including a dosage body (e.g. measuring space) that can include at least one peripheral wall defining a containment chamber. The peripheral wall can have an internal wall surface adjacent the containment chamber, the internal wall surface having a surface luminance. Indicia can be carried by the internal wall surface, the indicia having an indicia luminance. A contrast between the surface luminance and the indicia luminance can be at least about 0.67% on the Weber scale.

In accordance with another aspect of the technology, a container closure or cap can be provided, including a dosage body that can include at least one peripheral wall defining a containment chamber. The peripheral wall can have an internal wall surface adjacent the containment chamber. Indicia can be carried by the internal wall surface, the indicia being printed indicia.

In accordance with another aspect of the technology, a method of forming a container closure is provided, the method including: forming a dosage body having at least one peripheral wall defining a containment chamber, the peripheral wall having an internal wall surface adjacent the containment chamber, the internal wall surface having a surface luminance; applying indicia to the internal wall surface, the indicia being printed indicia having an indicia luminance; and selecting the surface luminance and the indicia luminance such that a contrast between the surface luminance and the indicia luminance is at least about 0.67% on the Weber scale.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 2:
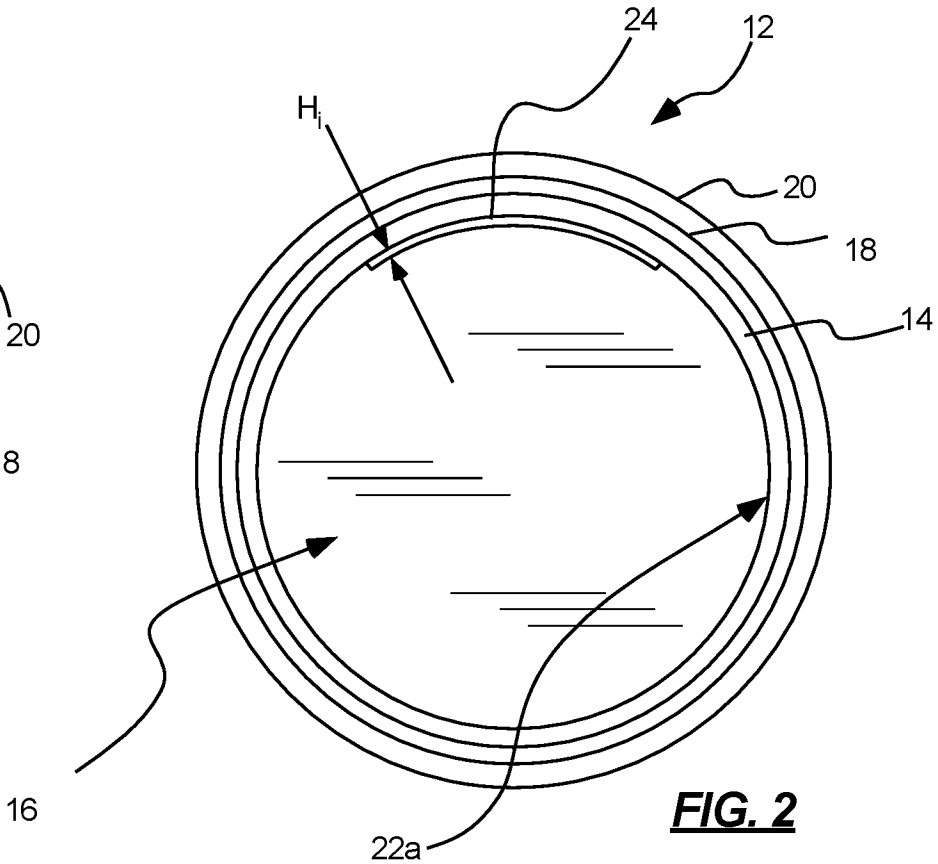
FIG. 2 is a top view of the closure of FIG. 1

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art having possession of this disclosure, are to be considered within the scope of the invention.

As used herein, the singular forms "a" "an" and "the" can include plural referents unless the context clearly dictates otherwise. Thus, for example, reference to "a closure" can include one or more of such closures, if the context dictates.

When visual contrasts are referenced numerically herein, the reference is made with respect to the Weber contrast scale, $C_w$. The Weber contrast is suitable to describe the contrast between a visual indicia and a homogeneous background. The difference from the luminance of the background ($L_b$) and the foreground (e.g., the indicia) ($L_r$) is divided by the luminance of the background:

$$C_W = \frac{(L_b - L_f)}{L_b}$$

In the Weber system, the highest possible contrast is 100%.

When indicia is referenced herein as being "printed indicia," it is to be understood that the indicia has been applied using a conventional printing process. Such printing processes include, without limitation, laser printing, ink-jet printing, pad printing, etc. In some cases, the printed indicia is applied to a substrate prior to the substrate being attached to or integrated with a cap or closure disclosed herein. For example, the printed indicia can be applied to a label or decal using one of the printing processes discussed herein, after which that label or decal can be attached to a cap or closure. In another embodiment, the printed indicia is applied to an in-mold label ("IML"), after which that IML is incorporated into a mold used while forming the cap or closure.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms are sometimes used herein to describe and claim various components of the systems of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art having possession of this disclosure.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

The present technology provides systems and methods for closures that can be used with a variety of containers. While the present technology can be applied to a variety of differing containers housing a variety of agents, the present closures have proven well suited for use with laundry detergents. The following discussion will focus primarily on these applications, with the understanding that the technology can be readily adapted for use with other containers, agents, applications, etc.

Laundry detergent is currently often offered to consumers in liquid form in a plastic bottle or jug. These bottles are often provided with so-called "dosing caps" that include information, formed in the cap, related to how much product to use. Such caps are most often opaque, with filling level indications formed on the inside of the cap that are created through engravings or ribs formed inside the cap. A consumer can remove the cap from the container, invert the cap, and fill the cap with detergent from the container while using the filling level indications as a guide to how much detergent to dispense.

Oftentimes, visibility and readability of the dosing indicators is very difficult, due to the limited contrast of the engravings or ribs in the cap. Consumers are often unable to correctly use the dosing indicators to properly dose the laundry detergent. In addition to difficulties in visibility, conventional dosing indicators are molded inside the cap: as such, changing the dosing information often requires retooling or creating a new mold, both of which are very expensive and time-consuming processes. Also, as such indicators are formed within the material of the cap itself, the addition of such information can compromise the structural integrity of the cap, or can require that more resin or polymer be used to ensure the cap is structurally sufficient to serve as a durable closure.

The present technology addresses these and other issues by including dosing indicators added to an inside of a closure or cap using techniques that both greatly enhance the contrast between the dosage indicators and the inside of the closure, and that greatly reduce the impact to the physical characteristics of the closure. In one embodiment of the invention, dosage indicators in the form of indicia are included within the cap or closure by using an in-mold label that can be applied during formation of the cap. In other embodiments, dosage information can be provided by printing directly on an inside surface of the cap. In another embodiment, the dosage information can be printed to a substrate which is then adhered within the cap or closure.

Figure 1:
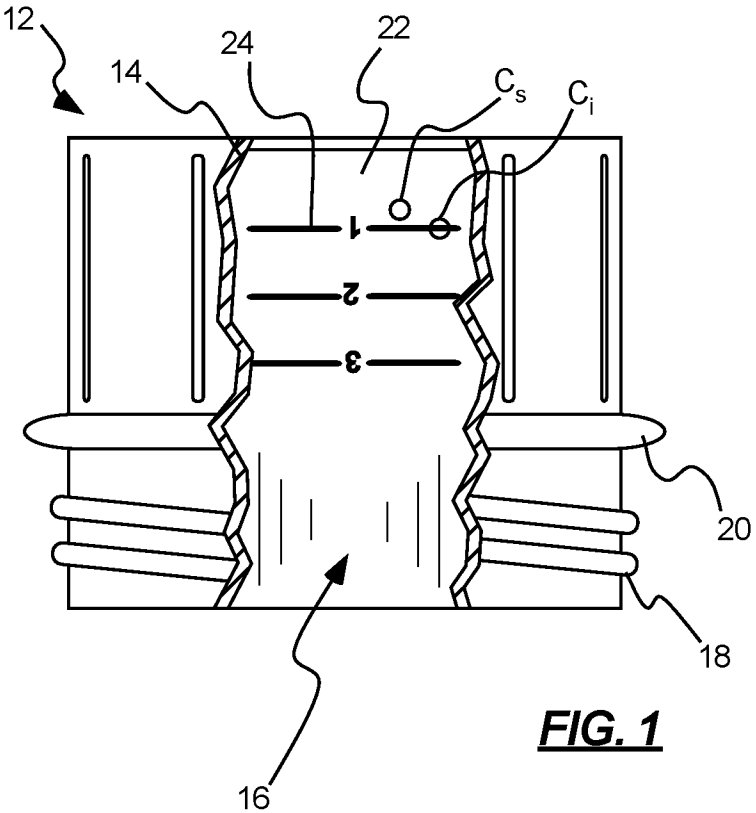
FIG. 1 is a front, partially sectioned view of a container closure in accordance with an embodiment of the invention, with the closure shown inverted for installation upon a container.

Turning now to FIGS. 1 and 2, one example of the present technology is shown that includes a container cap or closure 12. The cap or closure can be used to selectively seal a container within which an agent is stored. Typically, the agent is to be used by a consumer in specified doses. For example, the cap or closure can be used with a container of laundry detergent. The cap can serve both to seal the container of detergent for storage and transport, and, when removed, as a dosage meter for the detergent contained within the container. In FIG. 1, the cap 12 is shown in an inverted, or "upside down" configuration for attachment to a container. When used as a dosage meter, the cap would be inverted from the configuration shown (similar to the orientation of the cap 12*a* in FIG. 3).

The cap or closure 12 can include a dosage body that includes at least one peripheral wall 14 that partially or fully defines a containment chamber 16. In the example shown, a single peripheral wall is provided, creating a cylindrical containment chamber. Other configurations or shapes are also contemplated, however, that may require more than one peripheral wall. Attachment threads 18 can be included that allow the closure to be securely attached to a container. A hard stop 20 can be provided that securely seats against corresponding structure of the container.

The peripheral wall 14 can include an internal wall surface 22 that can lie immediately adjacent the containment chamber 16. Indicia 24 can be carried by the internal wall surface and can be visible by a consumer by sighting downwardly into the cap. In the example shown, the indicia includes exemplary dosage information that can be used by the consumer to determine how much detergent or other agent to use. The references 1, 2 and 3, along with corresponding level indicators, can be used by a consumer to determine how much detergent to use in a particular application. For example, detergent may be added to the cap to fill the cap to level "1" for a light load of laundry. An amount of detergent equal to level "2" may be used for a medium load, level "3" for a large load, etc.

The exemplary indicia 24 shown in the figures is for illustrative purposes only. The indicia can take a variety of forms including, without limitation, volumetric information, usage instructions, advertising, warning information, etc. The present technology can provide much more flexibility in quickly and inexpensively changing the information conveyed by the indicia. Thus, manufacturing decisions about the content and scope of the indicia are much less onerous than with previous technology.

Figure 3:
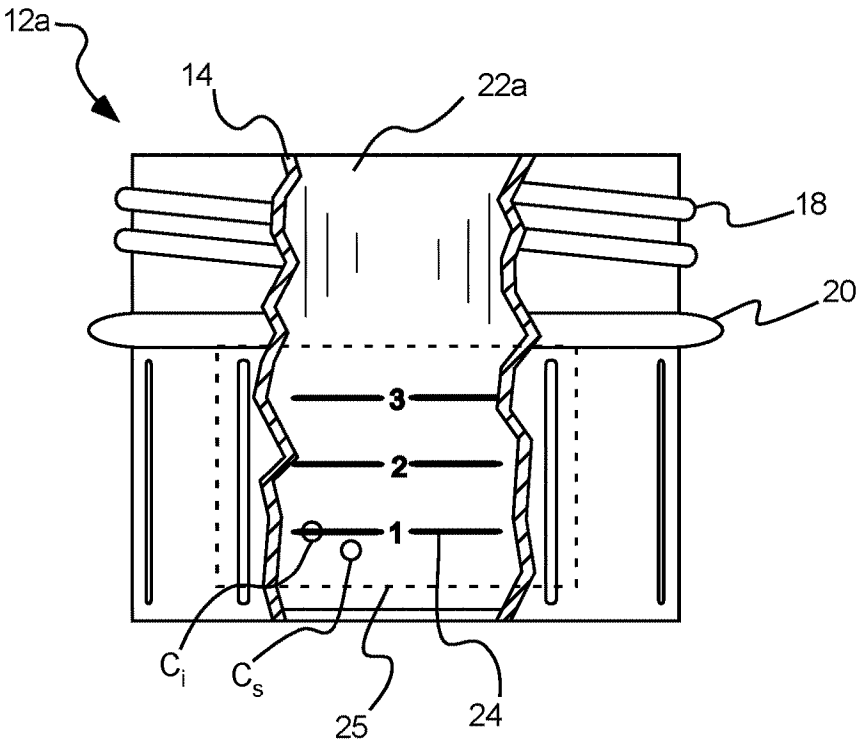
FIG. 3 is a front, partially sectioned view of a container closure in accordance with another embodiment of the invention, with the closure shown in an upright orientation to receive an agent.

In one exemplary embodiment of the technology, the internal wall surface 22 can have or exhibit a surface luminance, shown by example at location $C_s$. in FIGS. 1 and 3. Similarly, the indicia 24 carried by the internal wall surface can have or exhibit an indicia luminance, shown by example at $C_i$. A contrast between the surface luminance and the indicia luminance can be selected to provide ease of readability to a consumer to ensure that a consumer can clearly read the information provided by the indicia. While the amount of contrast provided by the present technology can vary, in one example the contrast is at least about 0.67% on the Weber scale. In another embodiment, the contrast is at least about 20% on the Weber scale. In another embodiment, the contrast is at least about 50% on the Weber scale.

The present inventors have found that dosage information provided by conventional methods of forming the dosage in the internal wall surface are very often difficult for consumers to read. The conventional ribs or troughs formed in the wall are inadequate to provide a sufficient level of contrast for most consumers. The present technology allows adjustment of the contrast level to better enable a wide range of consumers (having a wide range of eyesight) to use the present dosage caps.

Contrast viewing is generally understood as the ability to perceive differences in brightness. Generally, improving brightness differences improves the ability of most people to derive useful information from indicia. Differences in brightness can be understood as contrast. Contrast, in this context, is called luminance difference. While there are several definitions or scales that define the ratio from lighter to darker luminance, one popular method is the Weber scale. The Weber contrast is suitable to compare the contrast between a visual sign (indicia, in the present context) and a homogeneous background. The difference from the luminance of the background ($L_b$) and the foreground ($L_f$) is divided here only by the luminance of the background:

$$C_W = \frac{(L_b - L_f)}{L_b}$$

In the Weber system, a contrast of 100% is the highest possible contrast. The present system can achieve a wide range of contrast values, and can easily and inexpensively allow the selection of various background materials (e.g., the material used in forming the cap or closure) and foreground materials (e.g, the color, intensity and clarity of the indicia). By carefully controlling these variables, the optimal contrast can be provided to a consumer through relatively easily and inexpensively controlled variables.

The present technology achieves this flexibility while also providing a number of advantages. For example, using the present system, the color and/or composition of the closure can be selected to achieve other design goals, the present indicia can be adjusted to achieve the desired contrast regardless of the color or finish of the closure. When it is desired to change the information conveyed by the indicia, it is not necessary to change or modify existing molds: only the particular printing process need be changed. The printing systems utilized in the present technology can provide much higher resolution than molded ribs or troughs. The size of the present indicia can be adjusted for the best visual effect, without considering whether such change will adversely affect the structural integrity of the closure. Generally, more information can be provided with the present system than can reasonably be provided through molding techniques.

In one aspect of the technology, the indicia 24 comprises printed indicia. As that term is used herein, "printed indicia" is to be understood to refer to indicia that has been applied using a conventional printing process. Such printing processes include, without limitation, laser printing, ink-jet printing, pad printing, etc. In the embodiments shown in FIGS. 1 and 2, the printed indicia 24 is applied directly to the internal surface 22 of the peripheral wall 14. Using these technologies, it will be appreciated that a height $H_i$ of the printed indicia is created during printing (measured from a base of the indicia to an uppermost portion of the indicia). Generally, this height is very small. In one aspect of the invention, this height is less than about 40 μm. Were this small of a height utilized in molded indicia techniques, the molded indicia would not be visible to the human eye. However, as the present indicia can be printed using a variety of colors, line weights, type sizes, etc., the present technology can provide very good contrast levels.

Figure 4:
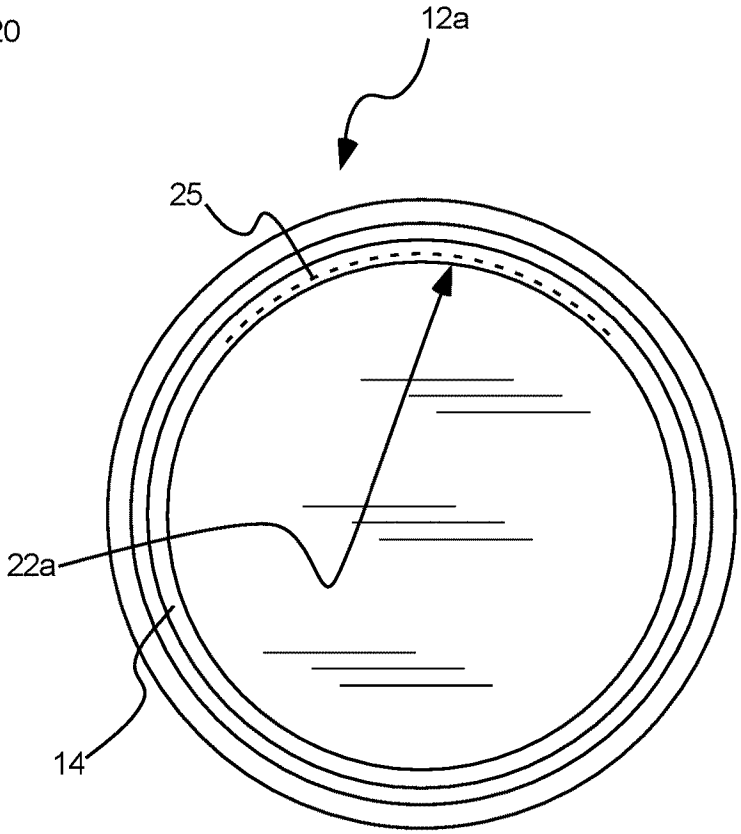
FIG. 4 is a top view of the closure of FIG. 3.

In a further example of the technology, shown in FIGS. 3 and 4, instead of being printed directly to the internal wall surface 22, the indicia 24 can be first applied to a printed substrate, after which the printed substrate can be attached to or integrated with a cap or closure. In the example shown, indicia 24 has been applied to substrate 25. In this example, substrate 25 is an in-mold label ("IML"). Whichever indicia is desired can be applied to the IML 25 prior to formation of the cap or closure. When the cap or closure is formed, the IML can be inserted into the mold and the mold material added to the mold. As the melted polymeric mold material fills the mold, the melted material joins with the IML material and creates an integral polymeric piece. The indicia is thus formed directly within the internal wall surface 22*a*. As shown in FIG. 4, in this example the printed substrate 25 would not protrude forwardly from the internal wall surface 22*a* but is rather partially consumed by or joined with the mold material as the cap 12*a* is formed.

It is noted that the IML printed substrate 25 shown in FIGS. 3 and 4 is shown having a boundary indicated by a dashed line. In practice, there would very likely be no definite boundary between the IML material and the mold after formation of the closure 12*a*: the two materials will essentially join with one another after the cap has cooled.

In addition to the IML printed substrate 25 shown, in another example of the technology, the printed substrate 25 can include a substrate similar to known decals, labels or the like. In this aspect, the indicia 24 can be applied to the substrate 25, and the substrate can later be positioned on and adhered to the internal wall surface 22*a* where desired.

In addition to the structural components discussed above, the present invention also provides various methods of forming container closures. The methods can include, without limitation, forming a dosage body having at least one peripheral wall defining a containment chamber, the peripheral wall having an internal wall surface adjacent the containment chamber, the internal wall surface having a surface luminance; applying indicia to the internal wall surface, the indicia being printed indicia having an indicia luminance; and selecting the surface luminance and the indicia luminance such that a contrast between the surface luminance and the indicia luminance being at least about 0.67% on the Weber scale.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

What is claimed is:

1. A container closure, comprising:

a dosage body including at least one peripheral wall defining a containment chamber, the peripheral wall having an internal wall surface adjacent the containment chamber, the internal wall surface having a surface luminance; and indicia, carried by the internal wall surface, the indicia having an indicia luminance that is lower than the surface luminance, a contrast between the surface luminance and the indicia luminance being at least about 0.67% on the Weber scale.

2. The closure of claim 1, wherein the contrast between the surface luminance and the indicia luminance is at least about 20% on the Weber scale.

3. The closure of claim 1, wherein the contrast between the surface luminance and the indicia luminance is at least about 50% on the Weber scale.

4. The closure of claim 1, wherein the indicia comprises printed indicia.

5. The closure of claim 4, wherein the printed indicia includes an indicia height, the indicia height being less than about 40 μm.

6. The closure of claim 4, further comprising a printed substrate carried by the internal wall surface, the indicia being printed on the printed substrate.

7. The closure of claim 6, wherein the printed substrate comprises an in-mold label formed at least partially in the internal wall surface.

8. A container closure, comprising:

a dosage body including at least one peripheral wall defining a containment chamber, the peripheral wall having an internal wall surface adjacent the containment chamber, the internal wall surface having a surface luminance;

indicia, carried by the internal wall surface, the indicia comprising printed indicia and having an indicia luminance that is lower than the surface luminance, a contrast between the surface luminance and the indicia luminance being at least about 0.67% on the Weber scale.

9. The closure of claim 8, wherein the printed indicia includes an indicia height, the indicia height being less than about 40 μm.

10. The closure of claim 8, further comprising a printed substrate carried by the internal wall surface, the printed indicia being printed on the printed substrate.

11. The closure of claim 10, wherein the printed substrate comprises an in-mold label at least partially formed in the internal wall surface.

12. The closure of claim 10, wherein the printed substrate comprises a label adhered to the internal wall surface.

13. The closure of claim 8, wherein the printed indicia is printed directly on the internal wall surface.

14. A method of forming a container closure, comprising:

forming a dosage body having at least one peripheral wall defining a containment chamber, the peripheral wall having an internal wall surface adjacent the containment chamber, the internal wall surface having a surface luminance; and applying indicia to the internal wall surface, the indicia being printed indicia having an indicia luminance that is lower than the surface luminance;

selecting the surface luminance and the indicia luminance such that a contrast between the surface luminance and the indicia luminance is at least about 0.67% on the Weber scale.

15. The method of claim 14, wherein applying the indicia to the internal wall surface comprises applying a printed substrate to the internal wall surface, the printed indicia being printed on the printed substrate.

16. The method of claim 15, wherein the printed substrate comprises an in-mold label, and wherein forming the dosage body includes forming the in-mold label at least partially within the internal wall surface.

17. The method of claim 15, wherein the printed substrate comprises a label, and wherein applying the indicia to the internal wall surface comprises adhering the label to the internal wall surface.

18. The method of claim 14, wherein the contrast between the surface luminance and the indicia luminance is at least about 20% on the Weber scale.

19. The method of claim 14, wherein applying the printed indicia to the internal wall surface includes printing the printed indicia directly on the internal wall surface.

* * * * *